US007959513B2

(12) United States Patent
Ochi

(10) Patent No.: US 7,959,513 B2
(45) Date of Patent: Jun. 14, 2011

(54) AMUSEMENT DEVICE

(75) Inventor: Yasushi Ochi, Izumisano (JP)

(73) Assignee: Bld Oriental, Ltd., Izumisano-shi Osaka (JP)

( * ) Notice: Subject to any disclaimer, the term of this patent is extended or adjusted under 35 U.S.C. 154(b) by 170 days.

(21) Appl. No.: 12/440,853

(22) PCT Filed: Sep. 11, 2007

(86) PCT No.: PCT/JP2007/067618

§ 371 (c)(1),
(2), (4) Date: Mar. 11, 2009

(87) PCT Pub. No.: WO2008/032687

PCT Pub. Date: Mar. 20, 2008

(65) Prior Publication Data

US 2010/0048310 A1 Feb. 25, 2010

(30) Foreign Application Priority Data

Sep. 12, 2006 (JP) ..... 2006-246459

(51) Int. Cl.
*A63G 1/08* (2006.01)
*A63G 1/00* (2006.01)

(52) U.S. Cl. ..... 472/29; 472/32; 482/35

(58) Field of Classification Search ..... 472/28–29, 472/32–33; 482/35–37
See application file for complete search history.

(56) References Cited

U.S. PATENT DOCUMENTS 1,271,892 A * 7/1918 Habeshan ..... 472/6
7,182,694 B2 * 2/2007 Ochi ..... 472/29

FOREIGN PATENT DOCUMENTS

| | | | |
|---|---|---|---|
| JP | 23266 | U | 2/1912 |
| JP | 27-7055 | U | 8/1952 |
| JP | 36-9421 | U | 4/1961 |
| JP | 51-43411 | B | 4/1961 |
| JP | 49-85252 | U | 7/1974 |
| JP | 53-35669 | U | 3/1978 |
| JP | 3-70586 | A | 3/1991 |
| JP | 8-229244 | A | 9/1996 |
| JP | 2000-24328 | A | 1/2000 |

OTHER PUBLICATIONS

Yu kids Island, "2006 New Item", Sep. 15, 2006 (received date), BLD Oriental Co., Ltd.

* cited by examiner

*Primary Examiner* — Kien T Nguyen
(74) *Attorney, Agent, or Firm* — Smith Patent Office

(57) ABSTRACT

The present invention relates to an amusement device which comprises a rotating body formed in a disk shape and provided horizontally rotatably; a frame body which is fixedly arranged on the upper surface of the rotating body 10; a partition member which is fastened to the frame body for forming the play area; a plurality of beams which are mounted to the frame body across the play area horizontally; a plurality of floor portions which are supported by the frame body and the beams, and which partition the play area into a plurality of layered spaces; the support mechanism; and the rotation drive mechanism. The support mechanism supports the rotating body. The rotation drive mechanism rotates the rotating body horizontally.

4 Claims, 15 Drawing Sheets

AMUSEMENT DEVICE

TECHNICAL FIELD

The present invention relates to an amusement device with which it is possible to enjoy various plays while enjoying the sensation caused by horizontal rotation of a rotating body.

BACKGROUND ART

As an amusement device with which it is possible to enjoy the sensation caused by rotation of a rotating body, conventionally, the amusement devices disclosed in Japanese Unexamined Patent Application Publication Nos. 8-229244 and 2000-24328 are known, for example.

The amusement device of Japanese Unexamined Patent Application Publication No. 8-229244 is configured with a riding portion (rotating body) which has a rotating shaft rotating about an axis somewhat tilted from the up-and-down direction, and which is formed in a shape imitating a coffee cup; a support mechanism for supporting the riding portion so that the riding portion is rotatable about the axis of the rotating shaft; and other components. In this amusement device, the riding portion rotates appropriately, thereby, players riding on the riding portion can enjoy the sensation felt when the riding portion rotates.

The amusement device of Japanese Unexamined Patent Application Publication No. 2000-24328 is configured with: a rotating base (rotating body) which rotates approximately horizontally, and which is configured so that players can ride on the upper surface thereof; a support mechanism for supporting the rotating base so that the rotating base is rotatable; and other components. In this amusement device, the rotating base rotates appropriately, thereby, the players riding on the rotating base can enjoy the sensation felt when the rotating base rotates.

Patent document 1: Japanese Unexamined Patent Application Publication No. 8-229244.

Patent document 2: Japanese Unexamined Patent Application Publication No. 2000-24328.

DISCLOSURE OF INVENTION

Problem Invention is to Solve

However, in the above conventional amusement devices, there is a problem that the plays with the amusement devices are apt to be monotonous and to make the players bored. Additionally, these amusement devices are common and there is also a problem that it is difficult to make children who are accustomed to playing with such amusement devices want to play the amusement devices many times.

The present invention has been achieved in view of the above-described circumstances, and an object thereof is to provide an amusement device with which players can enjoy varied plays, and which can attract interests of children.

Means for Resolving the Problem

To achieve the above-described object, the present invention relates to an amusement device, comprising:

a rotating body provided horizontally rotatably;

a structure for playing arranged to the rotating body for letting players play with;

support means for supporting the rotating body so that the rotating body is horizontally rotatable; and rotation drive means for rotating the rotating body horizontally.

According to this invention, the players such as children can enjoy various plays with the structure for playing while the rotating body is rotated horizontally by the rotation drive means. Therefore, the players can enjoy the play while enjoying the sensation felt when the structure for playing is rotated horizontally by the horizontal rotation of the rotating body.

In this way, according to the amusement device of the present invention, movement of the players themselves playing with the structure for playing and movement of the structure for playing resulting from the horizontal rotation of the rotating body are combined together, thereby, the players can enjoy varied plays and sensations which have not been provided by the conventional one. Further, it is possible to interest children around the amusement device who watch the rotating movements of the rotating body, the structure for playing and the players in playing with the amusement device, and to lead them to play with the amusement device.

The structure for playing is configured with a plurality of poles which are each formed along a predetermined direction and provided in a standing state at a position eccentric to a rotation center axis of the rotating body on the upper surface of the rotating body. Each pole may be configured so that the player can climb up and down.

In this case, the players can play by climbing up and down with their arms and legs the poles which are revolved about the rotation center axis of the rotating body by the rotation of the rotating body. Because the poles revolve about the rotation center axis of the rotating body, the players can enjoy the play while enjoying the sensation felt when revolving with the poles.

Each pole may have a curved portion or a bent portion between both end portions thereof. When thus configured, the poles themselves are diversified, thereby, it is possible to diversify the pole climbing more and to make the pole climbing more difficult than when the poles are formed straight. As a result, the play with the amusement device can be made more amusing.

Further, a cushion may be provided on the upper surface of the rotating body at least in the periphery of the position where the poles stand. When thus configured, if the players accidentally fall off the poles, the shock can be reduced by the cushion, thereby, effectively preventing the players from being injured.

The structure for playing may be configured with a support body fixedly arranged on the upper surface of the rotating body and a plurality of revolving members which are each hung from the support body at a position eccentric to the rotation center axis of the rotating body, and which are revolved about the rotation center axis by the rotation of the rotating body. Each revolving member may have a holding portion which the player holds and hangs on.

In this case, the players can play by holding and hanging on the holding portions of the revolving members which are revolved about the rotation center axis of the rotating body by the rotation of the rotating body, and hanging on and swinging the revolving members. Because the revolving members revolve about the rotation center axis of the rotating body, the players can enjoy the play while enjoying the sensation felt when revolving in a hanging state.

The support body may be configured with a plurality of support arms which are arranged radially around the rotation center axis of the rotating body and at an equal interval in the circumferential direction, and one end sides of which are each connected to the rotating body, and from the other end side of each of which one of the revolving member is hung; and a connection member formed in an annular shape for connecting and fixing the support arms. Connecting and fixing the plurality of support arms by means of the connecting member in this way is convenient for arranging the support arms at an equal interval.

Further, an annular cushion may be provided at least in the lower area of the revolving members which are revolved about the rotation center axis by the rotation of the rotating body. When thus configured, even if the players accidentally fall off the poles, the shock can be reduced by the cushion, thereby, effectively preventing the players from being injured.

Further, the structure for playing may be configured with: a frame body fixedly arranged on the upper surface of the rotating body for forming a play area which is separated from the outside space, and where the players play; a partition member which is fastened to the frame body for forming the play area; and at least one beam which is mounted to the frame body across the play area. The structure for playing may also be configured with: a frame body fixedly arranged on the upper surface of the rotating body for forming a play area which is separated from the outside space, and where the players play; a partition member which is fastened to the frame body for forming the play area; and at least one floor portion which is configured by one or a plurality of members, and which partitions the play area into layered spaces. In the floor portion, communicating portions for allowing the spaces adjacent in the up-and-down direction to communicate with each other may be formed.

In this case, similarly to a jungle gym, the players can play by within the play area moving laterally or up and down along the beam, moving laterally on the floor portion, and moving up and down through the communicating portions of the floor portion. Because the beam and the floor portion are rotated by the rotation of the rotating body, the players can enjoy the play while enjoying the sensation felt when the beam and the floor portion rotate.

Further, a cushion may be provided on the upper surface of the rotating body at least within the play area. When thus configured, even if the players accidentally fall off the poles, the shock can be reduced by the cushion, thereby, effectively preventing the players from being injured.

Effects of the Invention

As described above, according to the amusement device of the present invention, the movement of the players themselves and the movement resulting from the rotation of the rotating body are combined together, thereby, the players can enjoy varied plays and sensations which have not been provided by the conventional one. Further, it is possible to interest children around the amusement device who watch the rotating movements of the rotating body, the structure for playing and the players in playing with the amusement device, and to lead them to play with the amusement device.

LEGEND

Figure 1:
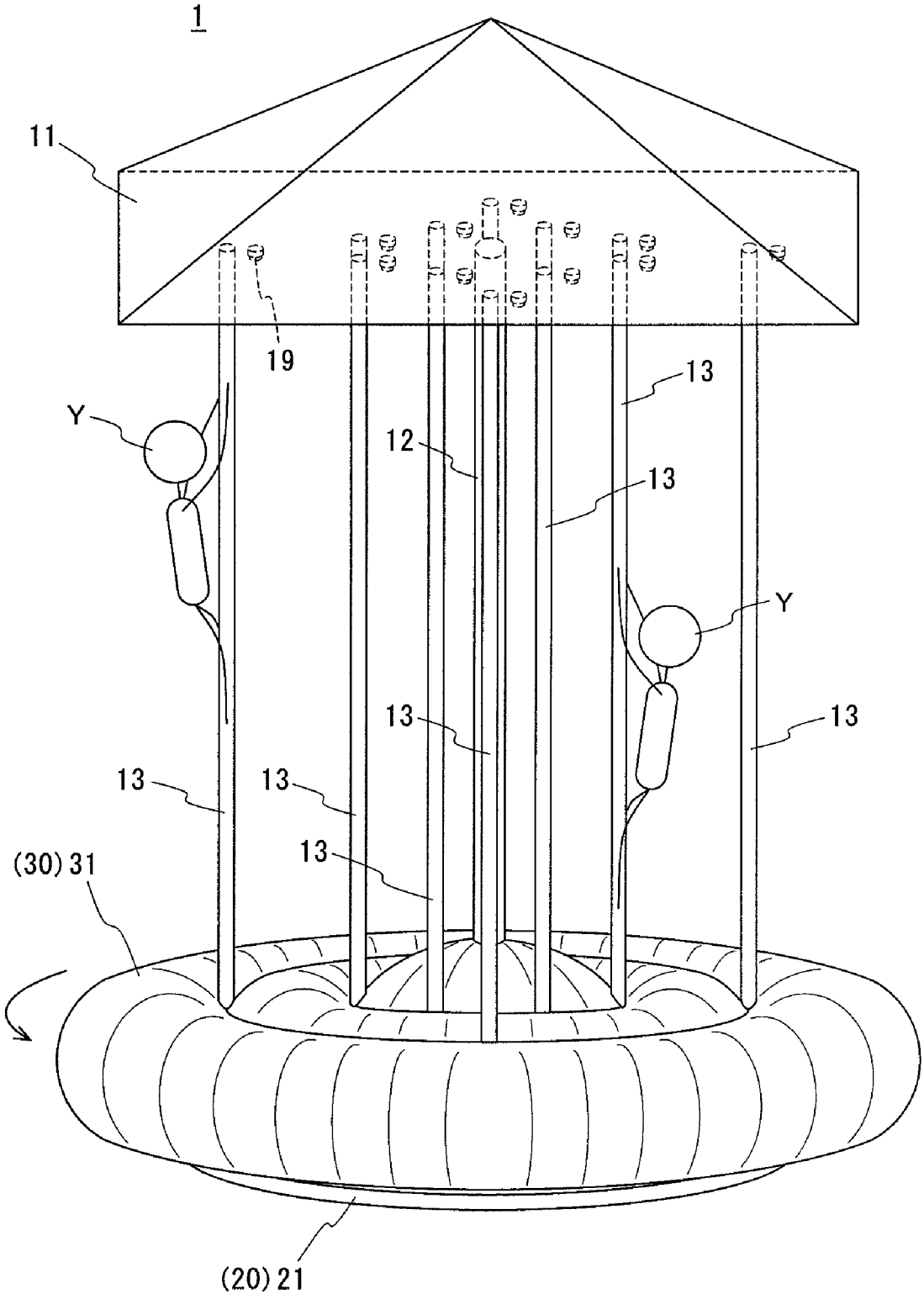
FIG. 1 is a perspective view showing a schematic configuration of an amusement device according to one embodiment of the present invention.

1 Amusement device
10 Rotating body
11 Upper member
12 Strut
13 Pole
19 Push button
20 Support mechanism
21 Base
22 Rail
23 Annular member
24 Support roller
25 Rotation drive mechanism
26 Drive motor
27 Case
30 Air cushion
31 Sheet member
32 Blower
Y Player

BEST MODE FOR CARRYING OUT THE INVENTION

Figure 2:
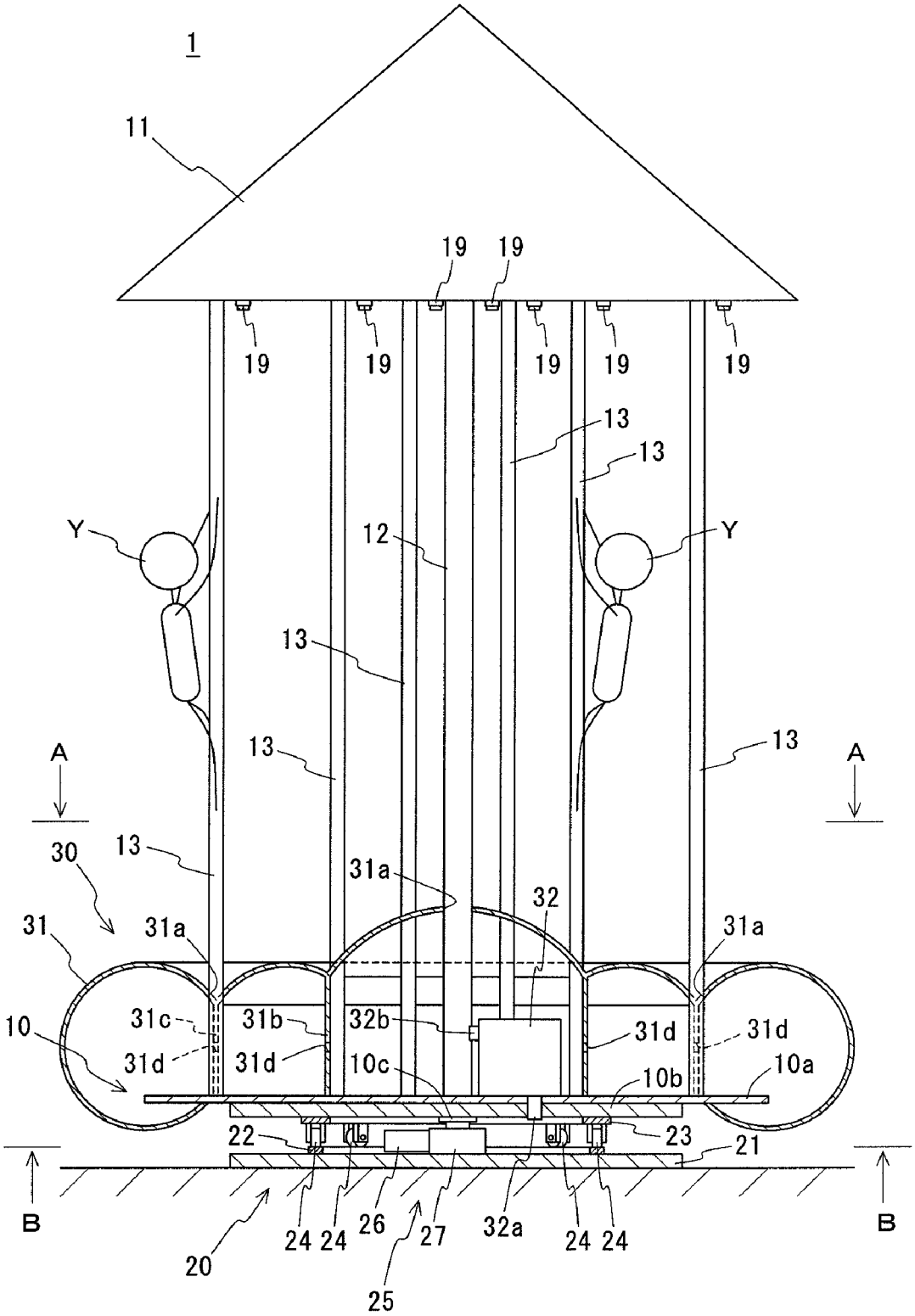
FIG. 2 is a cross-sectional view of the amusement device shown in FIG. 1.
Figure 3:
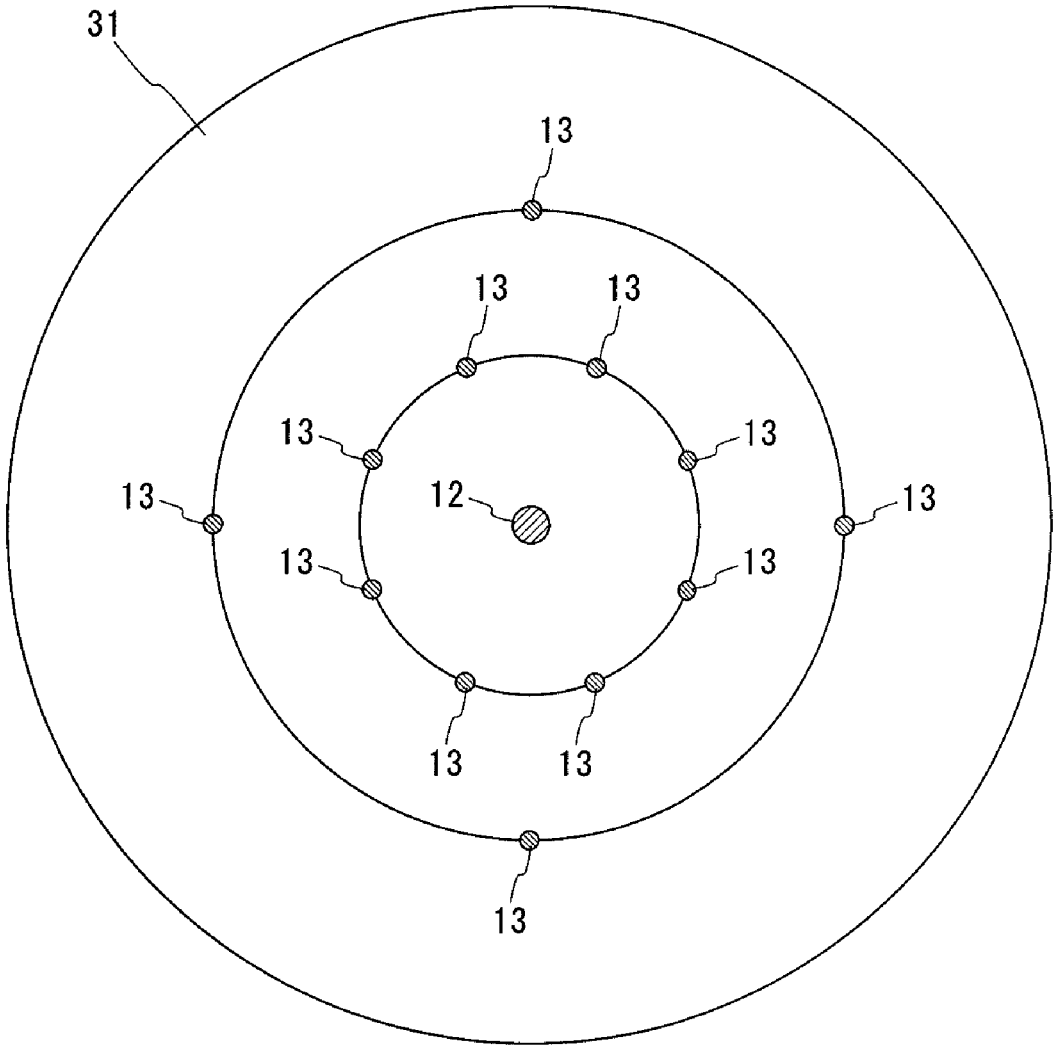
FIG. 3 is a cross-sectional view taken along the line A-A in FIG. 2.
Figure 4:
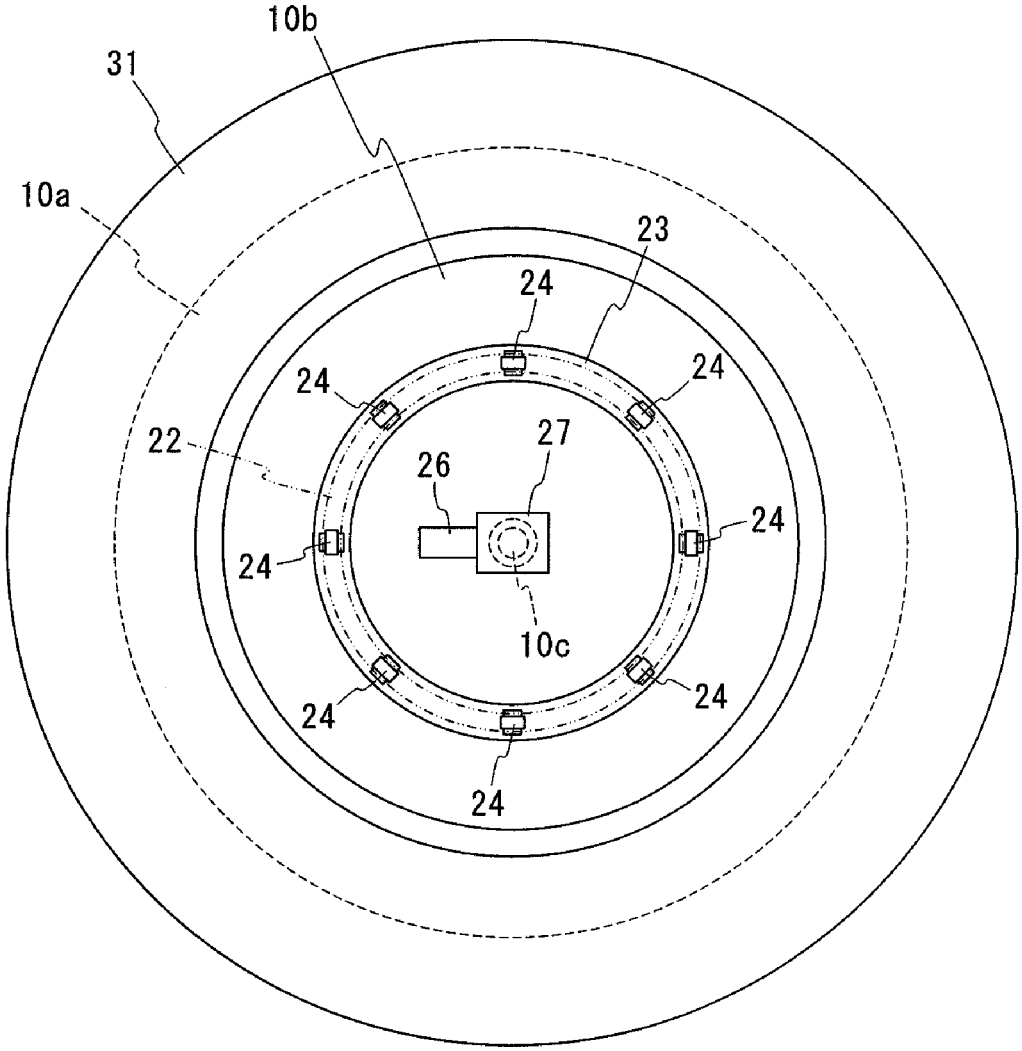
FIG. 4 is a cross-sectional view taken along the line B-B in FIG. 2.

Hereinafter, a specific embodiment of the present invention will be described with reference to the accompanying drawings. FIG. 1 is a perspective view showing a schematic configuration of an amusement device according to one embodiment of the present invention. FIG. 2 is a cross-sectional view of the amusement device shown in FIG. 1, FIG. 3 is a cross-sectional view taken along the line A-A in FIG. 2, and FIG. 4 is a cross-sectional view taken along the line B-B in FIG. 2.

As shown in FIGS. 1 to 4, an amusement device 1 according to the embodiment is configured with: a rotating body 10 formed in a disk shape and provided horizontally rotatably; an upper member 11 formed in a quadrangular pyramid shape and disposed at an upper position located at a certain distance from the upper surface of the rotating body 10; a strut 12 vertically arranged in the central portion of the upper surface of the rotating body 10 for supporting the lower surface of the upper member 11; a plurality of poles 13 which are each formed in a straight line and arranged with its axis directed in the up-and-down direction, the lower ends of which fixedly arranged on the upper surface of the rotating body 10, and the upper ends of which fixedly arranged on the lower surface of the upper member 11, the plurality of poles which players Y such as children climb up and down; a support mechanism 20 for supporting the rotating body 10 so that the rotating body 10 is horizontally rotatable; a rotation drive mechanism 25 for rotating the rotating body 10 horizontally; an air cushion 30 provided so as to cover the upper surface of the rotating body 10; and push buttons 19 which are arranged on the lower surface of the upper member 11 in one-to-one correspondence with the poles 13, and which are pressed by the players Y who have climbed up to the upper end portions of the poles 13.

The rotating body 10 is configured with: an upper disk 10*a*; a lower disk 10*b* provided below the upper disk 10*a*; and a rotating shaft 10*c*, the axis of which is directed in the up-and-down direction, and the upper end portion of which is fixedly arranged in the central portion of the lower surface of the lower disk 10*b*. The rotating shaft 10*c* rotates about its axis, and thereby the rotating body 10 rotates horizontally. The upper disk 10*a* is formed larger laterally than the lower disk 10*b*. Further, the outer surface of the upper member 11 is adorned with a not shown decoration. Thereby, it is possible to attract children.

In the embodiment, 12 poles 13 are provided in total. 8 poles 13 are arranged at an equal interval in the circumferential direction on a pitch circle being a certain distance away from the outer circumferential surface of the strut 12. 4 poles 13 are arranged at an equal interval in a circumferential direction on a pitch circle being larger than the pitch circle on which the 8 poles 13 are arranged. The lower end portions of the poles 13 are arranged on the upper surface of the upper disk 10*a* of the rotating body 10. The poles 13 are the structure for playing set forth in the claims.

The support mechanism 20 is configured with: a base 21 formed in a disk shape; a rail 22 which is formed in an annular shape and arranged on the upper surface of the base 21 co-axially with the rotating shaft 10*c* of the rotating body 10; an annular member 23 arranged on the lower surface of the lower disk 10*b* of the rotating body 10 co-axially with the rotating shaft 10*c*; and a plurality of support rollers 24 which are mounted to the annular member 23 at an equal interval in the circumferential direction so as to be located on a predetermined pitch circle around the axis of the annular member 23, and which are in contact with the rail 22. Each support roller 24 rolls along the rail 22, and thereby the rotating body 10 is supported horizontally rotatably.

The rotation drive mechanism 25 is configured with: a drive motor 26; a first gear (not shown) fixedly provided on an output shaft of the drive motor 26; a second gear (not shown) which is fixedly provided on the rotating shaft 10*c* of the rotating body 10, and which engages with the first gear (not shown); and a box-like case 27 which is arranged in the central portion of the upper surface of the base 21 of the support mechanism 20 for holding the gears (not shown), and on the side surface of which the drive motor 26 is arranged. Rotational power of the drive motor 26 is transmitted to the rotating shaft 10*c* via the gears (not shown), and thereby, the rotating body 10 rotates horizontally.

The air cushion 30 is configured with: a sheet member 31 having flexibility which is provided so as to cover the upper surface of the upper disk 10*a* of the rotating body 10, and which forms a closed space between the upper disk 10*a* and itself; and blower 32 which supplies air into the closed space to fill the closed space and increase the inner pressure, and thereby, inflates the sheet member 31.

The sheet member 31 is configured so that a hemispherical portion is formed in its central portion and two annular portions having different sizes are formed around the hemispherical portion when the sheet member 31 is inflated with the air supplied by the blower 32. The peripheral edge portion of the sheet member 31 is fastened to the outer circumferential side of the lower surface of the upper disk 10*a*, and a plurality of through holes 31*a* through each of which the strut 12 or one of the poles 13 penetrates up and down are formed at appropriate positions. The sheet member 31 is configured airtight so that air does not escape through gaps between the through hole 31*a* and the strut 12 and between the through holes 31*a* and the poles 13. The closed space is partitioned into a plurality of spaces by annular partition portions 31*b* and 31*c* which are fastened to the upper surface of the upper disk 10*a*. The partitioned spaces communicate with each other through communication holes 31*d* formed appropriately.

The blower 32 is arranged on the upper surface of the upper disk 10*a* and disposed within the closed space, and has an inlet pipe 32*a* provided so as to penetrate through the upper disk 10 and the lower disk 10*b* and an outlet pipe 32*b* opening within the closed space. When the blower 32 is actuated, air is supplied into the blower 32 through the inlet pipe 32*a*, and the air is discharged into the closed space through the outlet pipe 32*b* after reaching a predetermined pressure.

Each push button 19 inputs a signal into a control device (not shown) connected to a speaker (not shown) or a display device (not show) provided on the lower surface of the upper member 11 or the like. The control device (not shown) recognizes the order in which the push buttons 19 were pressed on the basis of the signals obtained from each push button 19, and outputs the order in which the push buttons 19 were pressed (that is, the order in which the players Y finished climbing up the poles 13) to the speaker (not shown) or the display device (not shown).

According to the amusement device 1 of the present embodiment configured as described above, the blower 32 is actuated first. Thereby, air is supplied into the closed space and fills the closed space, and the inner pressure thereof is increased. As a result, the sheet member 31 becomes in the inflated state.

Thereafter, the rotating body 10 is rotated horizontally by the rotation drive mechanism 25, and the upper member 11, the strut 12, the poles 13, and the air cushion 30 (inflated sheet member 31) rotate integratedly with the rotating body 10. Thereby, the poles 13 revolve about the axis of the rotating shaft 10*c* of the rotating body 10.

The players Y can play by climbing up and down with their arms and legs the poles 13 revolving in this way. Because the poles 13 revolve about the axis of the rotating shaft 10*c*, the players Y can enjoy the play while enjoying the sensation felt when revolving with the poles 13.

When the push buttons 19 are pressed by the players Y who have climbed up to the upper end portions of the poles 13, signals are inputted into the control device (not shown). Thereby, the order in which the push buttons 19 were pressed is recognized, and the recognized order is outputted from the speaker (not shown) as sound, or is displayed as an image on the display device (not shown). Therefore, the players Y can play by competing in speed of climbing up the poles 13.

Thus, according to the amusement device 1 of the present embodiment, the movement of the players Y themselves climbing up and down the poles 13 and the revolving movement of the poles 13 are combined together, thereby, the players Y can enjoy varied plays and sensations which have not been provided by the conventional one. Further, it is possible to interest children around the amusement device 1 who watch the rotating movements of the upper member 11, the strut 12, the poles 13, the air cushion 30, and the players Y in playing with the amusement device 1, and to lead them to play with the amusement device 1.

The air cushion 30 is provided on the upper surface of the rotating body 10, thereby, even if the players Y accidentally fall off the poles 13, the shock can be reduced by the air cushion 30 and it is possible to efficiently prevent the players Y from being injured.

Thus, one embodiment of the present invention has been described above. However, specific modes which the present invention can realize are not limited thereto.

Figure 5:
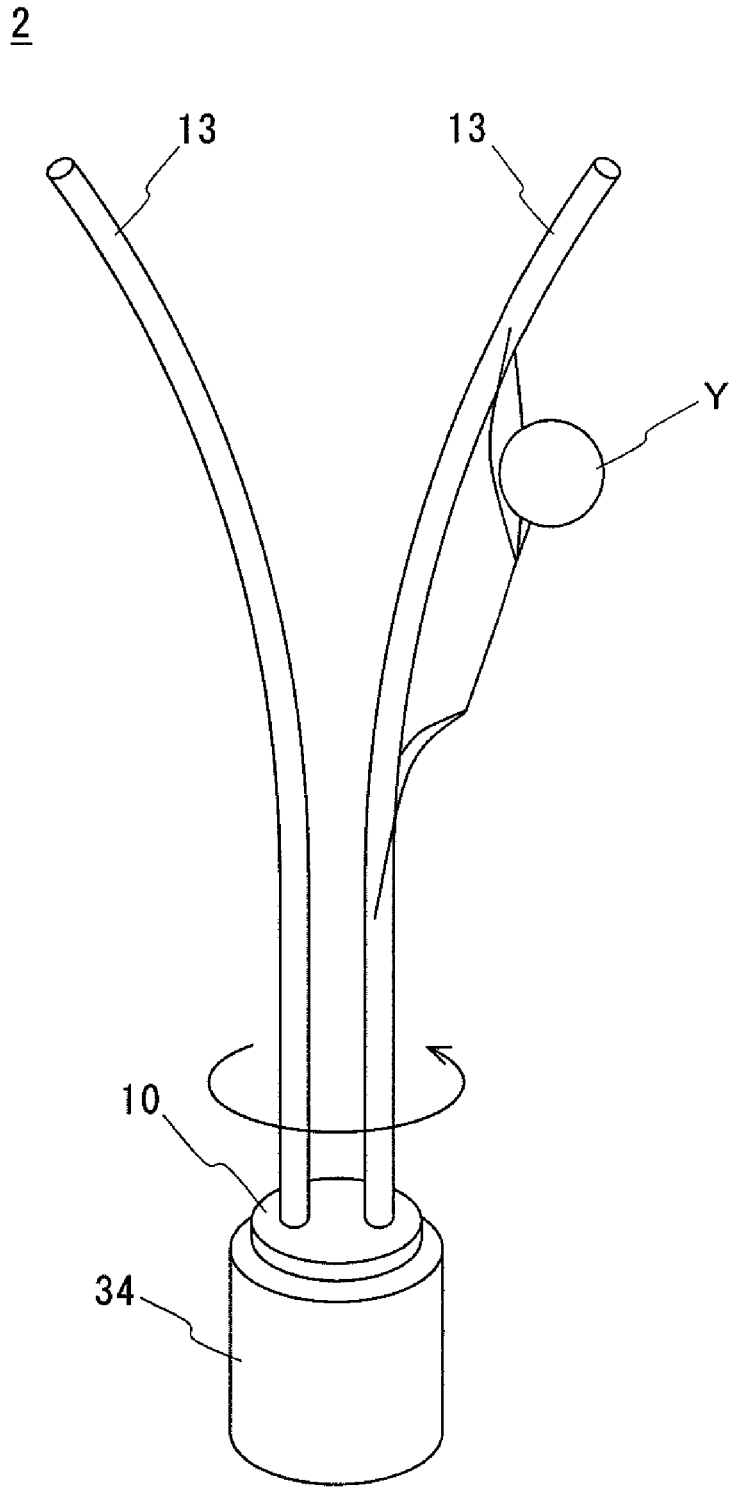
FIG. 5 is a perspective view showing a schematic configuration of an amusement device according to another embodiment of the present invention.
Figure 6:
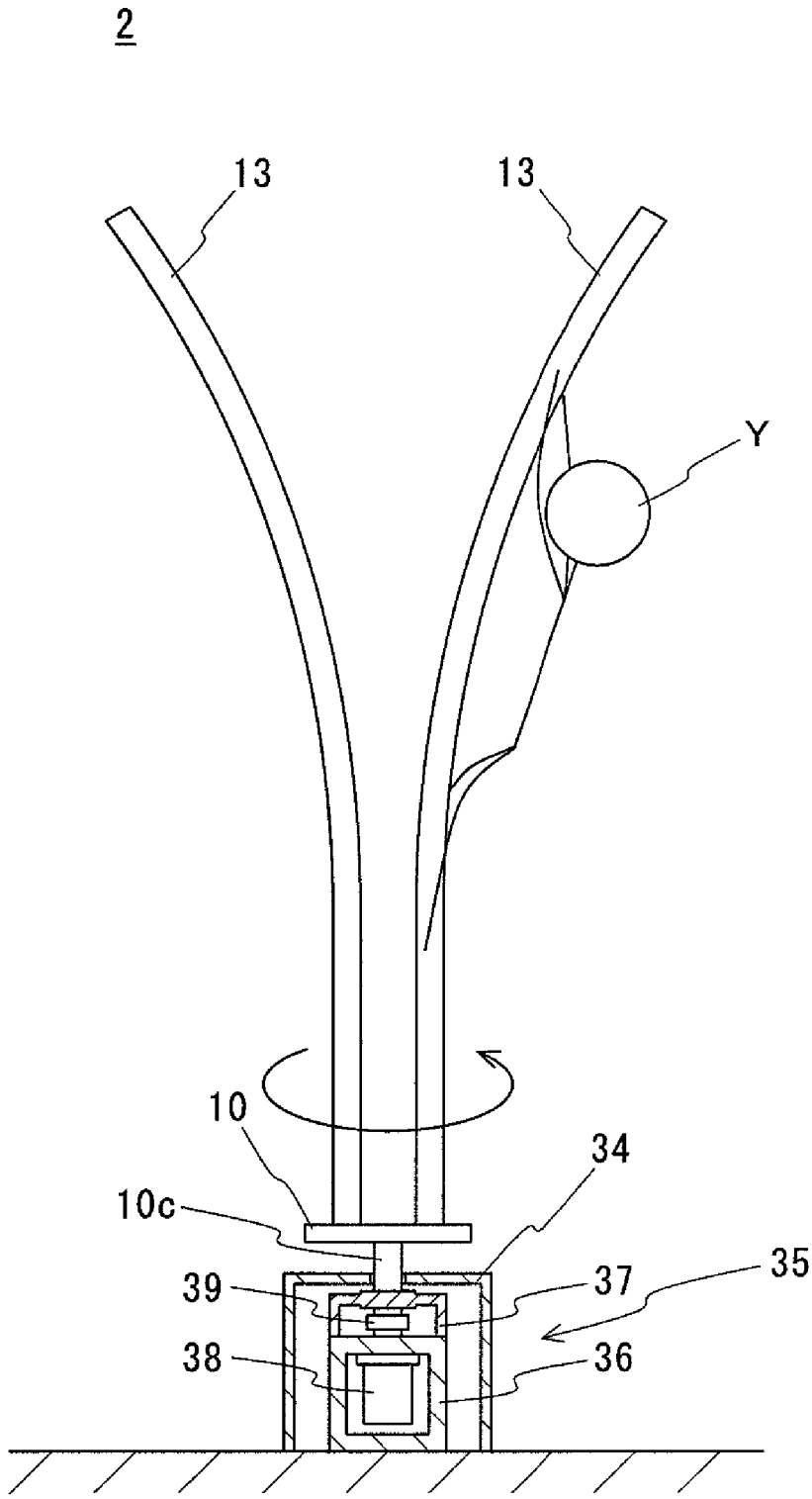
FIG. 6 is a cross-sectional view of the amusement device shown in FIG. 5.

In the above embodiment, each pole 13 is formed in a straight line and arranged with its axis directed along the up-and-down direction, but it is not limited thereto. For example, as an amusement device 2 shown in FIG. 5 and FIG. 6, the upper end portion of each pole 13 may be curved. FIG. 5 is a perspective view showing a schematic configuration of an amusement device according to another embodiment of the present invention, and FIG. 6 is a cross-sectional view of the amusement device shown in FIG. 5.

The amusement device 2 is configured with: the disk-shaped rotating body 10 having the rotating shaft 10*c*; two poles 13 which are each vertically arranged on the rotating body 10 at the position eccentric to the axis of the rotating shaft 10*c*; a support mechanism 35 for supporting the rotating body 10 so that the rotating body 10 is horizontally rotatable; and a drive motor 38 for rotating the rotating body 10 horizontally.

The support mechanism 35 is configured with: a support base 36 for supporting the drive motor 38 so that an axis of an output shaft of the drive motor 38 is directed along the up-and-down direction; and a support member 37 arranged on the upper surface of the support base 36 for supporting the rotating shaft 10*c* so that the rotating shaft 10*c* is rotatable about its axis. The rotating shaft 10*c* and the output shaft of the drive motor 38 are connected via a coupling 39. The support mechanism 35 and the rotating shaft 10*c* are covered with a cover body 34 so that the upper end side of the rotating shaft 10*c* penetrates.

In the amusement device 2 thus configured, when the drive motor 38 is driven, the rotating shaft 10*c* rotates about the axis and thereby the poles 13 revolve about the axis of the rotating shaft 10*c*. Therefore, the players Y can play similarly to the above. Further, because the poles 13 themselves are diversified by curving the upper end portions thereof, it is possible to diversify the climbing of the poles 13 more and to make the climbing of the poles 13 more difficult than when the poles 13 are each formed straight. As a result, the play with the amusement device 2 can be made more amusing.

Although not particularly shown in the drawings, besides the shape shown in FIG. 5 and FIG. 6, each pole 13 may be formed to have between both end portions a curved portion or a bent portion provided so as to wind from side to side, for example. Also when thus configured, it is possible to diversify the climbing of the poles 13 and to make the climbing of the poles 13 difficult.

Further, each push button 19 may be configured so that when it is pressed, a circuit for outputting a sound (music, human voice or the like) is switched on and the sound is outputted, or a circuit for turning on a lamp is switched on and the lamp is turned on, instead of outputting the order.

The air cushion 30 is not limited to the above described cushion. It is possible to employ, for example, a cushion using an elastic body such as springs, rubber or sponge, instead of the air cushion 30. Further, the sheet member 31 may be decorated to interest children.

Instead of configuring the amusement devices 1 and 2 so that the players Y climb up and down the poles 13, it is possible to configure amusement devices 3 and 4 so that the players Y hang on revolving members 45 and revolve as shown in FIGS. 7 to 10.

Figure 7:
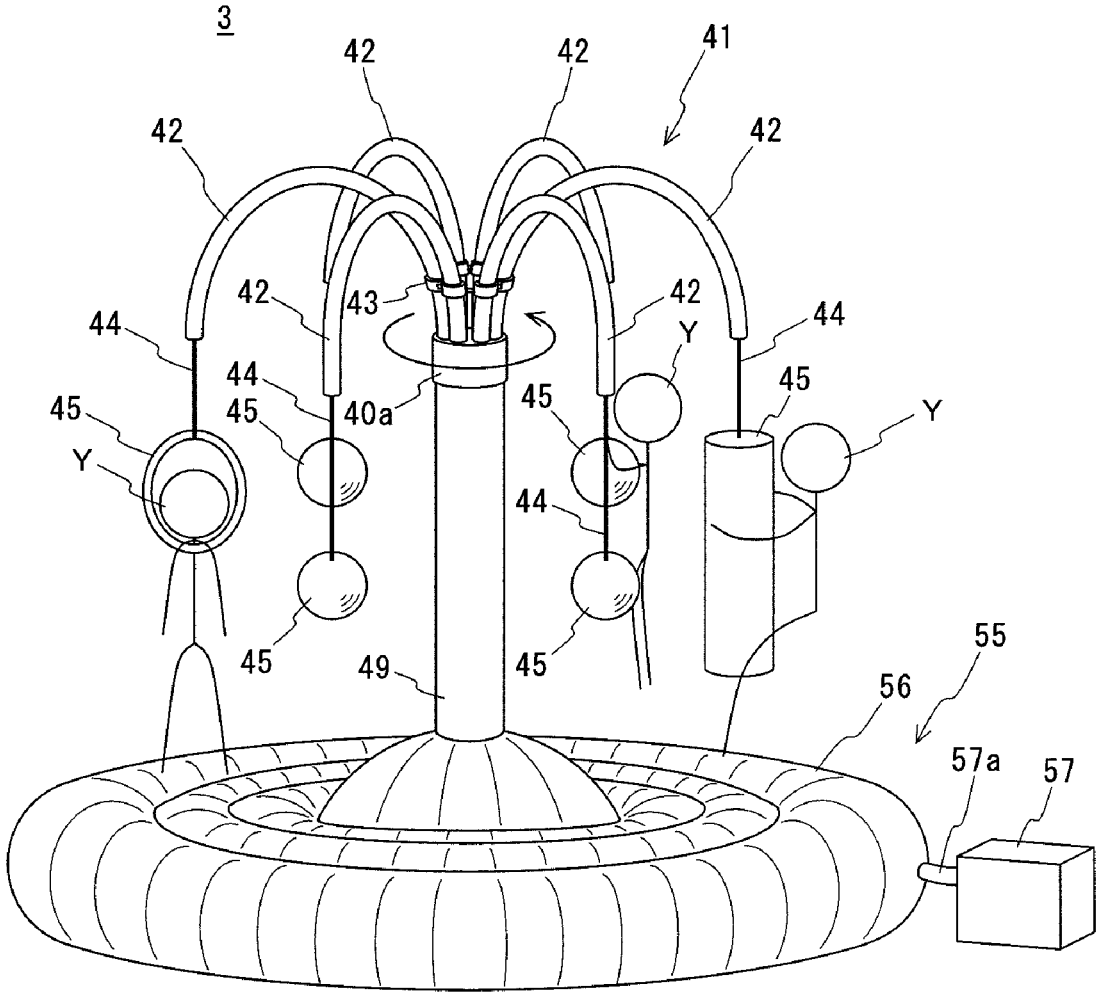
FIG. 7 is a perspective view showing a schematic configuration of an amusement device according to another embodiment of the present invention.
Figure 8:
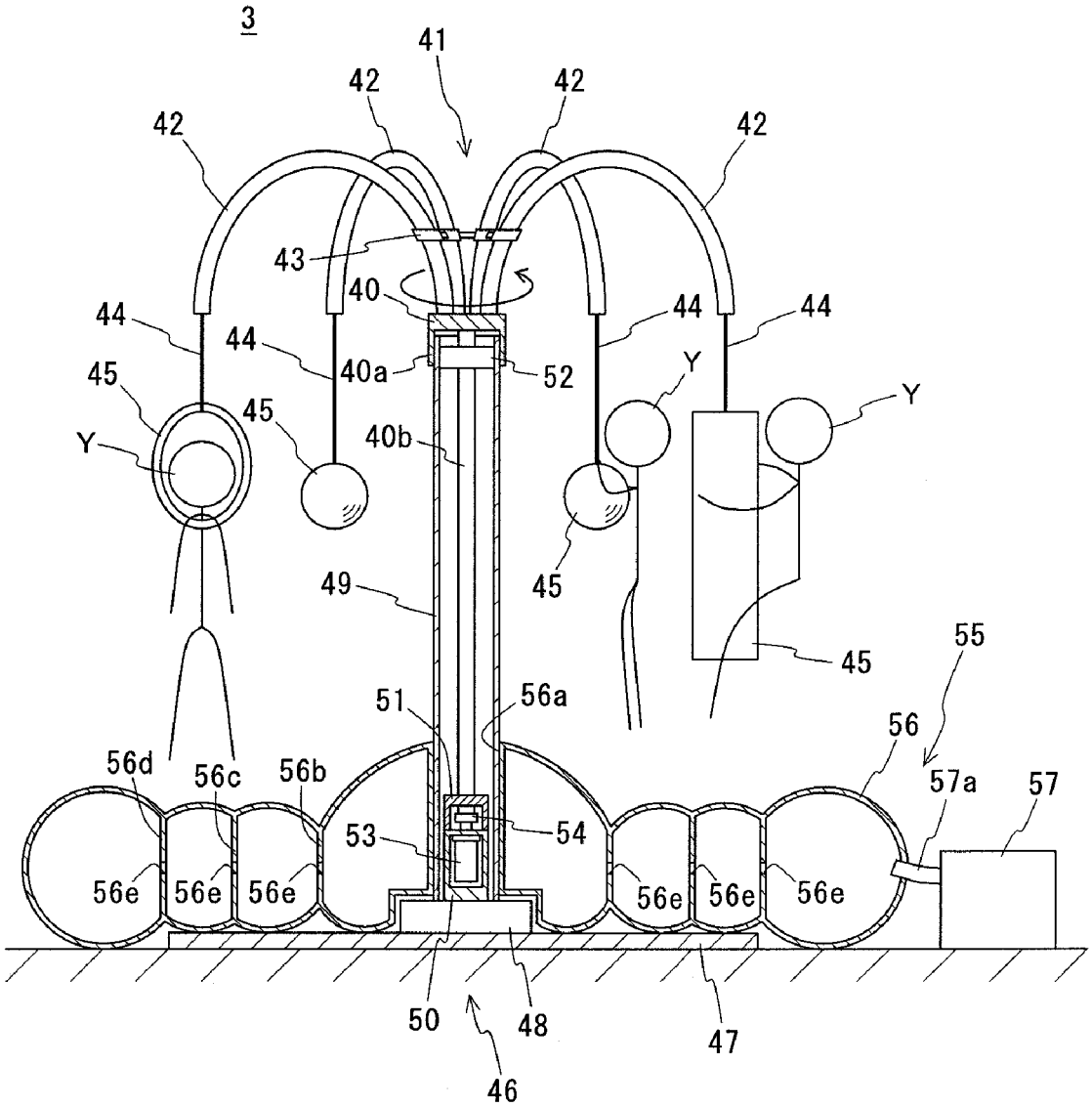
FIG. 8 is a cross-sectional view of the amusement device shown in FIG. 7.
Figure 9:
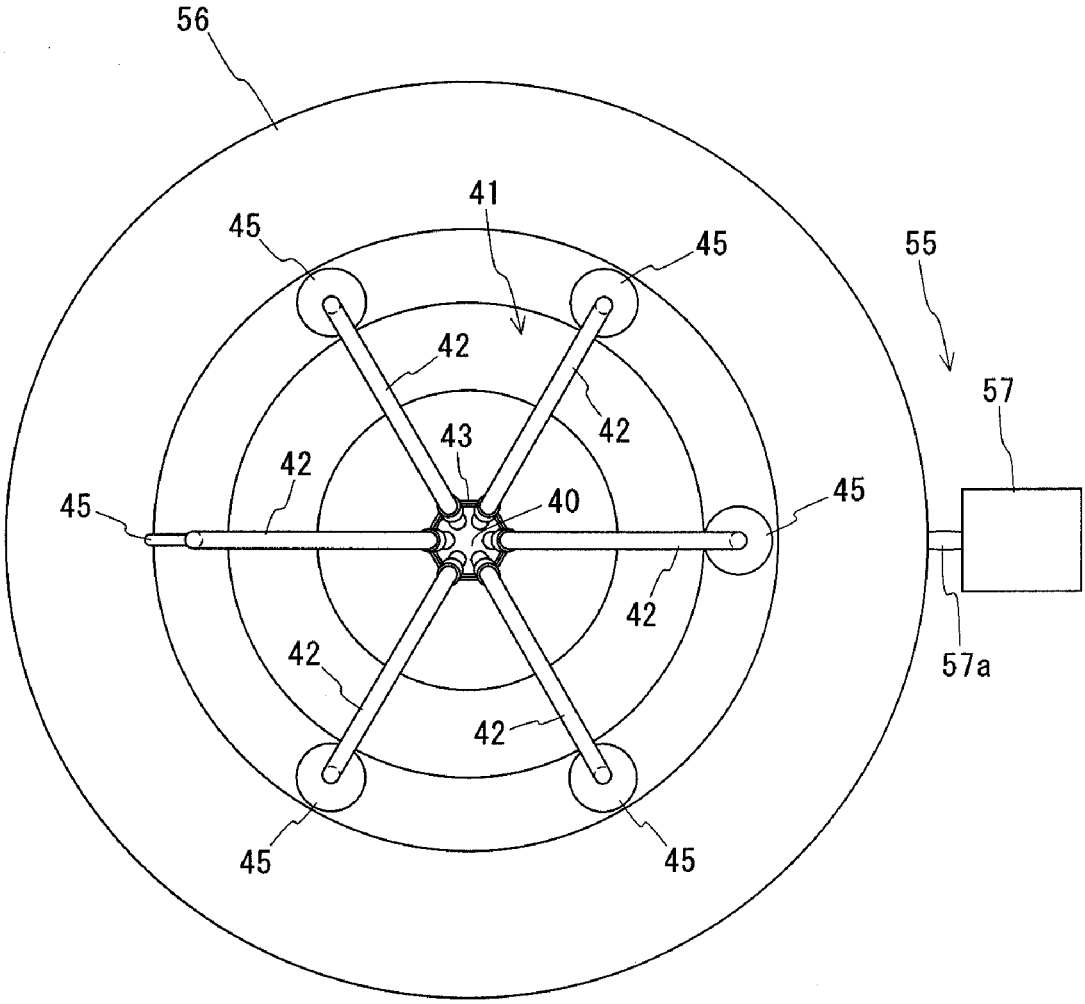
FIG. 9 is a plan view of the amusement device shown in FIG. 7.

As shown in FIGS. 7 to 9, the amusement device 3 is configured with: a rotating body 40 formed in a disk shape and provided horizontally rotatably; a support body 41 fixedly arranged on the upper surface of the rotating body 40; a plurality of revolving members 45 (6 members in this embodiment) which are each hung from the support body 40 with a hanging rope 44 at a position eccentric to a rotation center axis of the rotating body 40 (axis of a rotating shaft 40*b*), the position located at a certain distance from an outer circumferential surface of a later described support pipe 49, and which are revolved by the rotation of the rotating body 40; a support mechanism 46 for supporting the rotating body 40 so that the rotating body 40 is horizontally rotatable; a drive motor 53 for rotating the rotating body 40 horizontally; and an air cushion 55 arranged in the lower area of the revolving members 45. FIG. 7 is a perspective view showing a schematic configuration of an amusement device according to another embodiment of the present invention, FIG. 8 is a cross-sectional view of the amusement device shown in FIG. 7, and FIG. 9 is a plan view of the amusement device shown in FIG. 7.

The rotating body 40 is configured with: an annular skirt portion 40*a* formed on the outer circumferential side of the lower surface of the rotating body 40; and the rotating shaft 40*b*, the upper end portion of which is fixedly arranged in the central portion of the lower surface of the rotating body 40, and which is arranged within the support pipe 49. The rotating shaft 40*b* rotates about its axis, and thereby, the rotating body 40 rotates horizontally. The skirt portion 40*a* is rotatably fitted onto the upper end portion of the support pipe 49. This prevents the players Y from inserting their hands into a gap between the rotating body 40 and the support pipe 49 and thereby being injured.

The support body 41 is configured with: a plurality of support arms 42 (6 arms in this embodiment) one end sides of which are connected on the upper surface of the rotating body 40, and which are arranged radially around the axis of the rotating shaft 40*b* of the rotating body 40 and at an equal interval in the circumferential direction, the plurality of support arms 42 on the other end side of each of which the hanging rope 44 is connected; and a connecting member 43 for connecting and fixing the one end sides of the support arms 42. Each support arm 42 is configured by a semicircular member.

Each revolving member 45 is formed in a spherical shape, an annular shape or a cylindrical shape, for example. Joint portions between the revolving members 45 and the hanging ropes 44, the outer circumferential surfaces of the revolving members 45, the annular inner circumferential surfaces of the revolving members 45 and the like each function as holding portions which the players Y hold and hang on. The support body 41, the hanging ropes 44 and the revolving members 45 are the structure for playing set forth in the claims.

The support mechanism 46 is configured with: a base 47 formed in a disk shape; a cylindrical support base 48 arranged in the center portion of the upper surface of the base 47; the support pipe 49 which is formed to have a hollow inside and to be open at both end portions, and which is mounted and fixed on the upper surface of the support base 48 so that its axis is directed along the up-and-down direction; a support block 50 which is mounted and fixed on the upper surface of the support base 48 within the support pipe 49, and which supports the drive motor 53 so that an axis of an output shaft of the drive motor 53 is directed along the up-and-down direction; a lower support member 51 arranged on the upper surface of the support block 50 and by which the lower end portion of the rotating shaft 40*b* is supported rotatably around its axis; and an upper support member 52 which is fixedly arranged on the inner circumferential surface of the upper end portion of the support pipe 49, and by which the upper end portion of the rotating shaft 40*b* is supported rotatably about its axis. The lower end portion of the rotating shaft 40*b* and the output shaft of the drive motor 53 are connected via a coupling 54. The outer surface of the support pipe 49 is covered with a not shown shock absorbing member, thereby, preventing the players Y from being injured.

The air cushion 55 is configured with: a sheet member 56 having flexibility and having a closed space therein; and a blower 57 which supplies air into the closed space to fill the closed space and increase the inner pressure, and thereby inflates the sheet member 56.

The sheet member 56 is configured so that a hemispherical portion is formed in the center portion thereof and three annular portions having different sizes are formed around the hemispherical portion when it is inflated with the air supplied by the blower 57. The sheet member 56 is provided on the upper surface of the support base 47 of the support mechanism 46 in a state where the annular portion located at the most outer position is out of the support base 47. Further, the sheet member 56 has in the center portion a through hole 56*a* through which the support pipe 49 penetrates up and down. The closed space is partitioned into a plurality of spaces by annular partition portions 56*b*, 56*c* and 56*d*, and the partitioned spaces communicates to each other through communication holes 56*e* formed appropriately.

The blower 57 is disposed in the vicinity of the support base 47 on the outside of the sheet member 56, and has an outlet pipe 57*a* connected into the closed space. When the blower 57 is actuated, air is supplied into the blower 57 through an inlet pipe (not shown). The air is discharged into the closed space after reaching a predetermined pressure.

According to the amusement device 3 thus configured, the blower 57 is actuated first. Thereby, air is supplied into the closed space and fills the closed space, and the inner pressure is increased. As a result, the sheet member 56 becomes in an inflated state. Thereafter, when the drive motor 53 is driven, the rotating shaft 40*b* rotates about its axis and the rotating body 40 rotates horizontally. Thereby, the support arms 42 rotate and the revolving members 45 revolve about the axis of the rotating shaft 40*b*.

The players Y can play by holding and hanging on the holding portions of the revolving members 45 revolving in this way, or by hanging on and swinging the revolving members 45. Because the revolving members 45 revolve about the axis of the rotating shaft 40*b*, the players Y can enjoy the play while enjoying the sensation felt when the revolving in a hanging state.

Therefore, also when the amusement device 3 is thus configured, the movement of the players Y themselves holding and hanging on the revolving members 45 or shaking the revolving members 45 and the revolving movement of the revolving members 45 are combined together, thereby, the players Y can enjoy varied plays and sensations which have not been provided by the conventional one. Further, it is also possible to interest children around the amusement device 3 who watch the rotating movements of the support arms 42, the revolving members 45 and the players Y, in playing with the amusement device 3, and to lead them to play with the amusement device 3.

Further, the plurality of support arms 42 are connected and fixed by the connecting member 43. This is convenient for arranging the support arms 42 (revolving members 45) at an equal interval.

The air cushion 55 is provided on the upper surface of the base 47, thereby, even if the players Y accidentally fall off the revolving members 45, the shock can be reduced by the air cushion 55 and it is possible to efficiently prevent the players Y from being injured.

Figure 10:
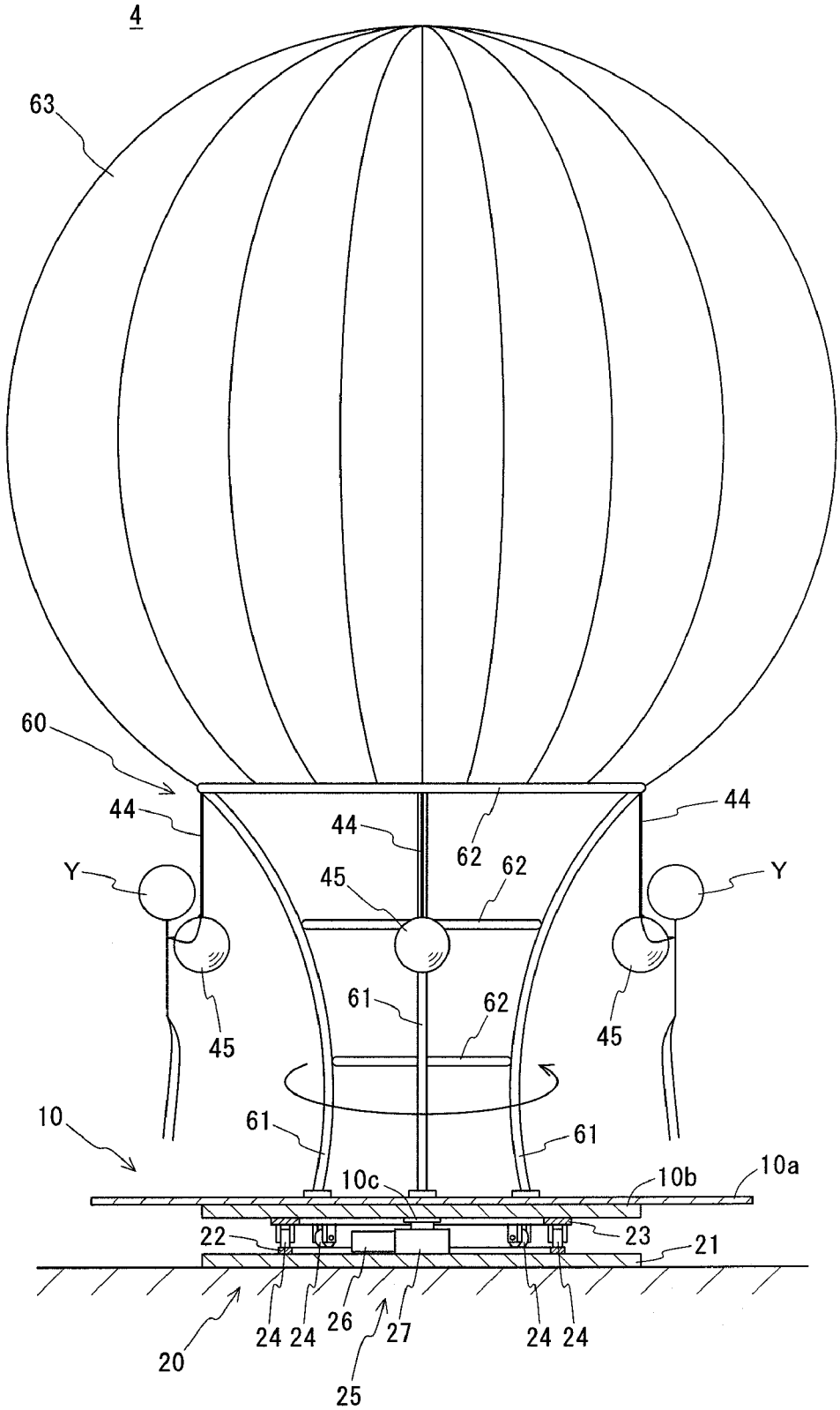
FIG. 10 is a cross-sectional view showing a schematic configuration of an amusement device according to another embodiment of the present invention.

On the other hand, as shown in FIG. 10, the amusement device 4 is provided with: the rotating body 10; a support body 60 fixedly arranged on the upper surface of the upper disk 10*a* of the rotating body 10; the plurality of revolving members 45 which are each hung from the support body 60 with the hanging rope 44 at a position eccentric to the axis of the rotating shaft 10*c* of the rotating body 10, and which are revolved by the rotation of the rotating body 10; the support mechanism 20; the rotation drive mechanism 25; and a decorative body 63 formed in a spherical shape, the outer circumferential surface of which is adorned with a not shown decoration, and which is supported at the lower portion by the support body 60. The decorative body 63 is provided for attracting children. FIG. 10 is a cross-sectional view showing a schematic configuration of an amusement device according to another embodiment of the present invention.

The support body 60 is configured with: a plurality of first support members 61 formed in an arc shape which are arranged at an equal interval in the circumferential direction of the rotating body 10, and one ends of which are fixedly arranged on the upper surface of the upper disk 10*a*; and a plurality of second support members 62 formed in an annular shape which are provided horizontally so as to be connected with the first support members 61 at different heights. Each second support member 62 is provided co-axially with the axis of the rotating shaft 10*c*.

The second member 62 located at the highest position is connected to the other ends of the first support members 61, and the hanging ropes 44 are connected thereto. Further, the lower portion of the decorative body 63 is attached to the second member 62 located the highest position. The support body 60, the hanging ropes 44 and the revolving members 45 are the structure for playing set forth in the claims. The outer surface of each of the support members 61 and 62 is covered with a not shown shock absorbing member, thereby, preventing the players Y from being injured.

Also according to the amusement device 4, because the support body 60 is rotated by the rotation of the rotating body 10 caused by the rotation drive mechanism 25 and the revolving members 45 revolve about the axis of the rotating shaft 10*c*, the players Y can play similarly to when playing with the amusement device 3 and a similar effect can be obtained.

The shapes of the revolving members 45 and the air cushion 55 are each not limited the shape described above. It is possible to employ a cushion using an elastic body such as springs, rubber, sponge or the like instead of the air cushion 55. The sheet member 56 may be decorated to interest children.

Further, instead of arranging the revolving members 45 on the same pitch circle, they may be arranged on pitch circles having different sizes.

It is possible to configure an amusement device 5 so that within a predetermined play area S the players Y can enjoy a play similar to that in a jungle gym as shown in FIGS. 11 to 15 instead of configuring the amusement devices 1 and 2 so that the players Y climb up and down the poles 13 and configuring the amusement devices 3 and 4 so that the players Y hang on the revolving members 45 and revolve.

As shown in FIGS. 11 to 15, the amusement device 5 is configured with: the rotating body 10; a frame body 70 which is fixedly arranged on the upper surface of the rotating body 10 for forming the play area S which is separated from the outside space, and where the players Y plays; a partition member 71 which is fastened to the frame body 71 for forming the play area S; a plurality of beams 72 which are mounted to the frame body 70 across the play area S horizontally; a plurality of floor portions 73 which are supported by the frame body 70 and the beams 72, and which partition the play area S into a plurality of layered spaces; the support mechanism 20; and the rotation drive mechanism 25.

Figure 11:
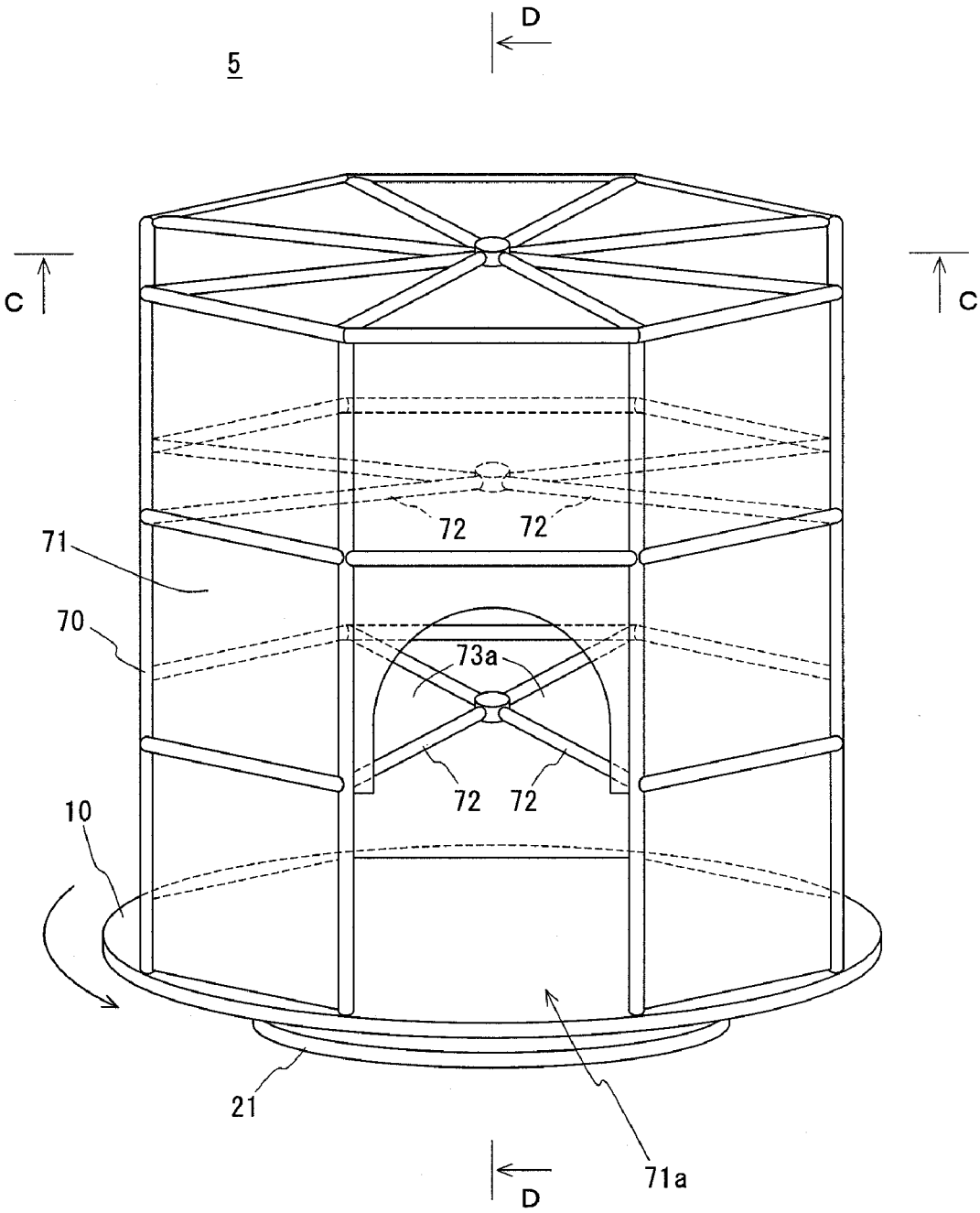
FIG. 11 is a perspective view showing a schematic configuration of an amusement device according to another embodiment of the present invention.
Figure 12:
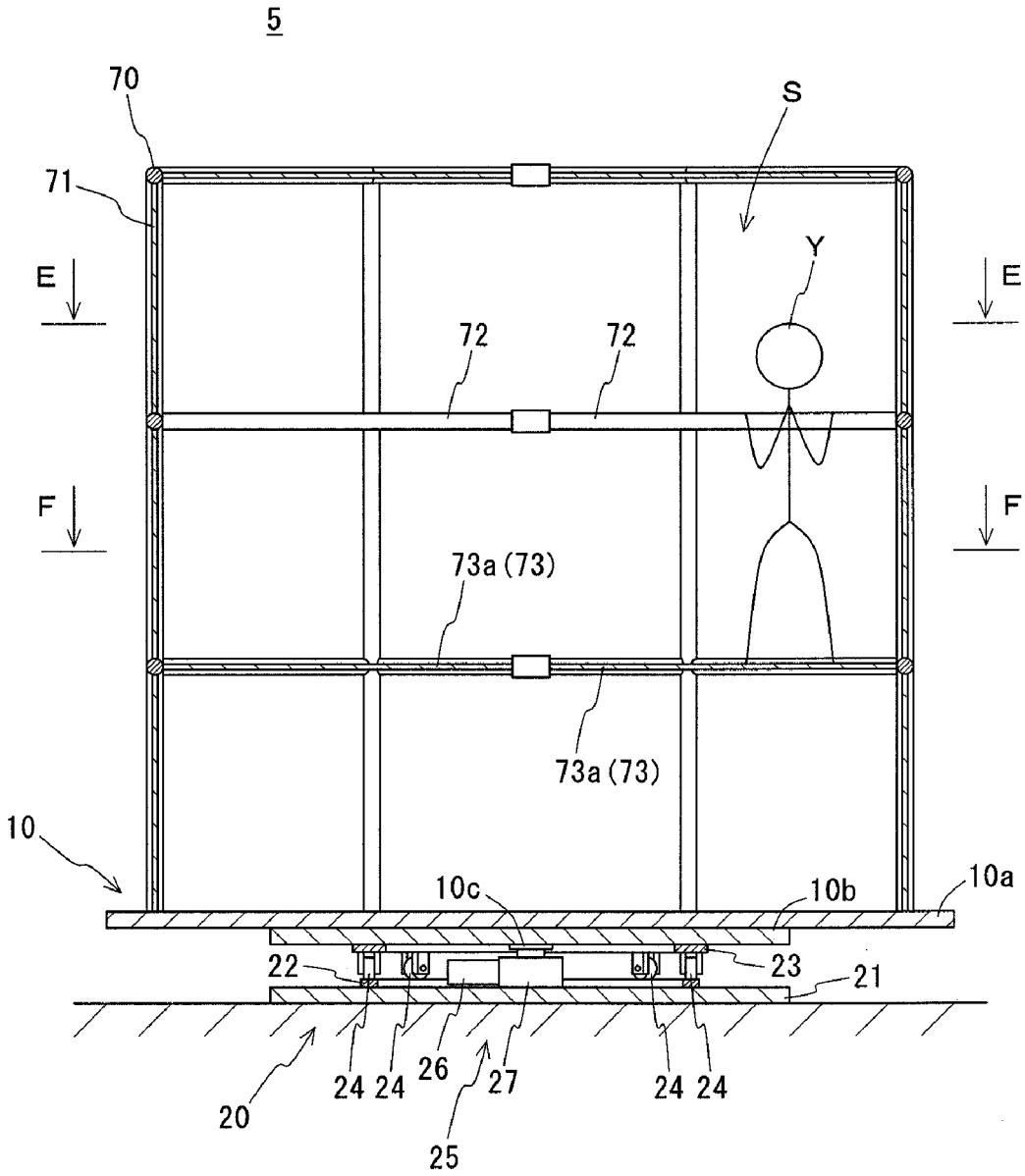
FIG. 12 is a cross-sectional view taken along the line C-C in FIG. 11.
Figure 13:
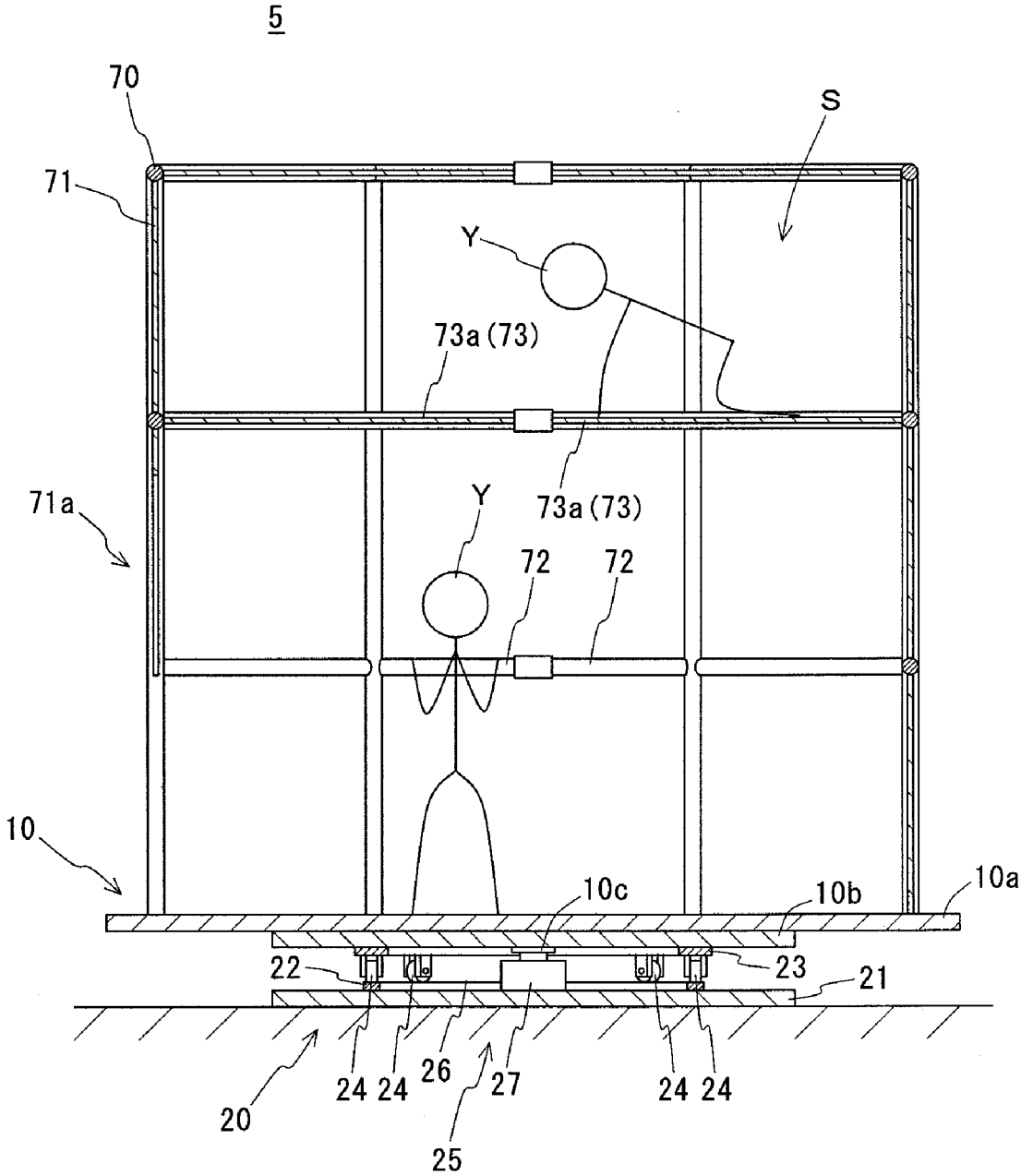
FIG. 13 is a cross-sectional view taken along the line D-D in FIG. 11.
Figure 14:
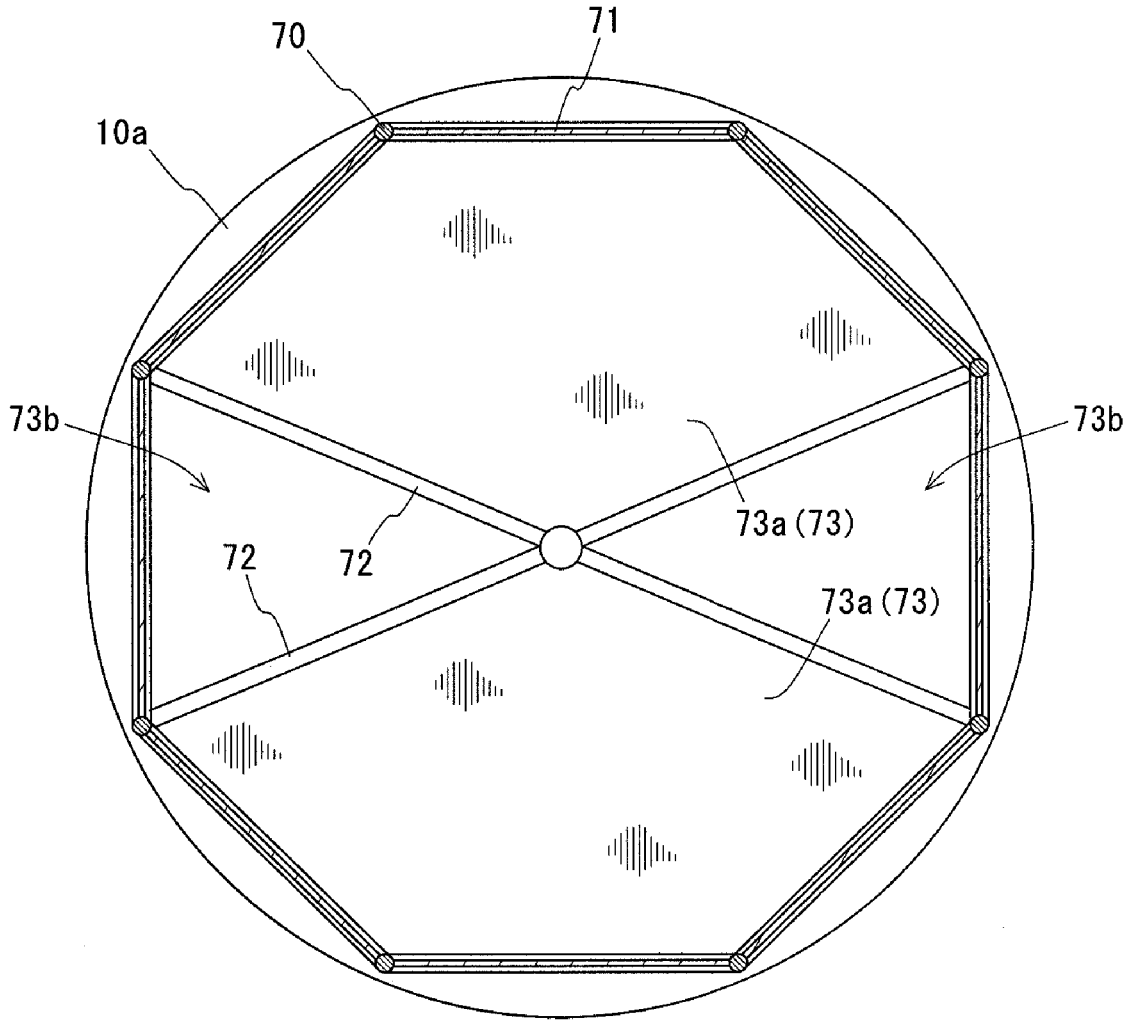
FIG. 14 is a cross-sectional view taken along the line E-E in FIG. 12.
Figure 15:
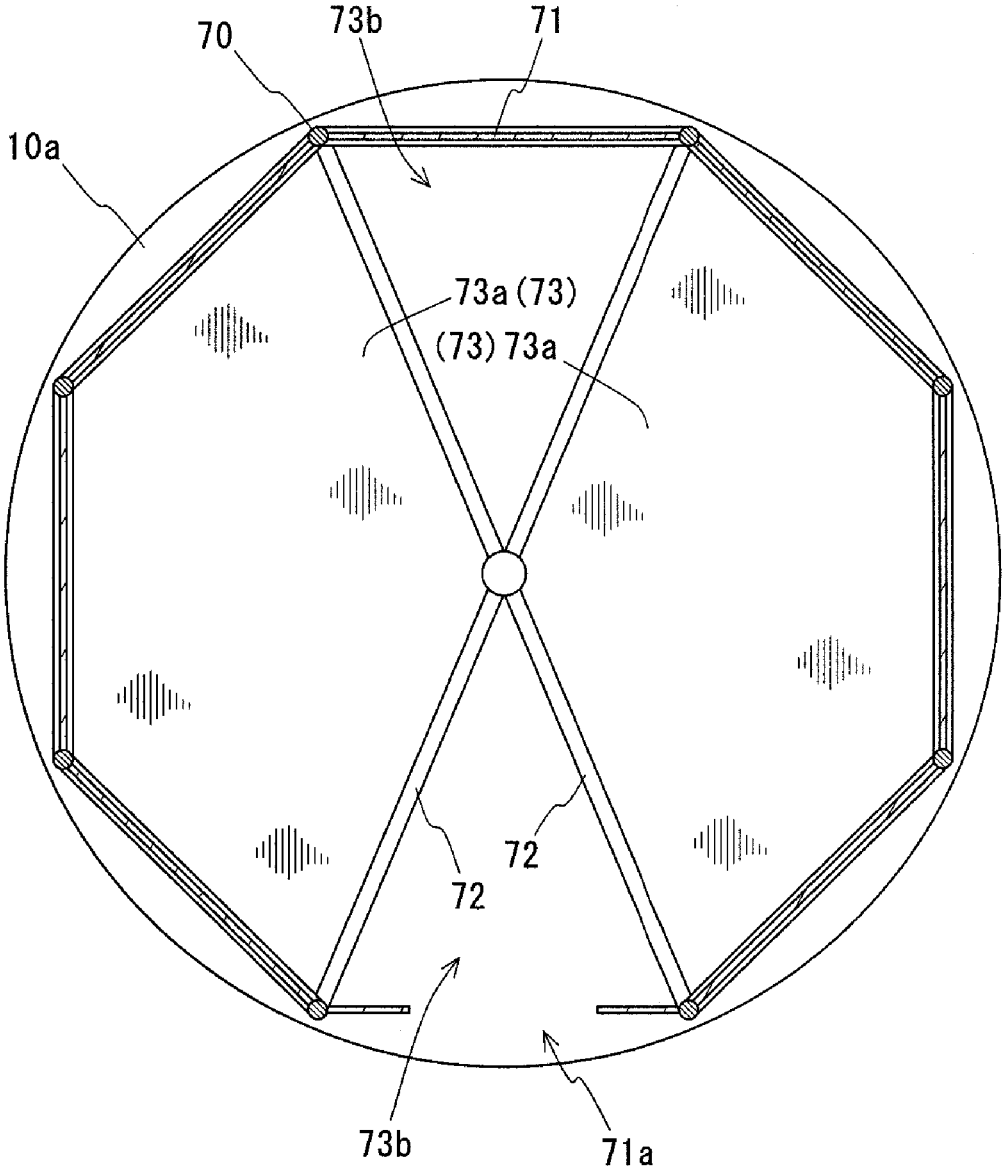
FIG. 15 is a cross-sectional view taken along the line F-F in FIG. 12.

FIG. 11 is a perspective view showing a schematic configuration of an amusement device according to another embodiment of the present invention, FIG. 12 is a cross-sectional view taken along the line C-C in FIG. 11, and FIG. 13 is a cross-sectional view taken along the line D-D in FIG. 11. FIG. 14 is a cross-sectional view taken along the line E-E in FIG. 12, and FIG. 15 is a cross-sectional view taken along the line F-F in FIG. 12. The frame body 70, the partition member 71, the beams 72 and the floor portions 73 are the structure for playing set forth in the claims.

The frame body 70 is configured to have an octagon shape in plan view by combining a plurality of bar-shaped members longitudinally and laterally. The outer surface of each structural member is covered with a not shown shock absorbing member, thereby, preventing the players Y from being injured.

The partition portion 71 is configured by a sheet-shaped member having flexibility and is stretched between each member configuring the frame body 70, and the outer surface thereof is adorned with a not shown decoration to attract children. Further, in the partition member 71, an opening portion 71*a* which allows the outside space and the play area S to communicate with each other, and through which the players Y can go in and out is formed.

The beams 72 are provided so as to connect, at two different heights in the up-and-down direction, the apexes of the octagon opposite to each other. Each floor portion 73 is configured with two sheet-shaped members 73*a* having flexibility, and stretched among the members configuring the frame body 70 and the beams 72. By the floor portions 73*b*, the play area S is partitioned into three spaces in the up-and-down direction. Further, in the floor portions 73, the sheet-shaped members 73*a* are not provided at the portions indicated by the reference numeral 73*b* in FIG. 14 and FIG. 15, and these portions function as communicating portions 73*b* for allowing the spaces adjacent in the up-and-down direction to communicate with each other. Through the connecting portions 73*b*, the highest space and the middle space, and the middle space and the lowest space each communicate with each other. Thereby, the players Y can move to the higher side or to the lower side. Further, the communicating portions 73*b* of the upper floor portion 73 and the communicating portions 73*b* of the lower floor portion are provided at different positions.

A not shown cushion is provided on the upper surface of the upper disk 10*a* of the rotating body 10, and the upper surfaces of the floor portions 73 are each covered a not shown shock absorbing member, thereby, preventing the players Y from being injured.

According to the amusement device 5 thus configured, when the rotating body 10 is rotated horizontally by the rotation drive mechanism 25, the frame body 70, the partition portion 71, the beams 72 and the floor portions 73 rotates integratedly with the rotating body 10.

And the players Y can play by within the play area S moving laterally inside the play area S along the beams 72, moving laterally on the floor portions 73, and moving up and down through the communicating portions 73*b* of the floor portions 73, similarly to when playing in a jungle gym. Because the beams 72, the floor portions 73 and the other components are rotated by the rotation of the rotating body 10, the players Y can enjoy the play while enjoying the sensation felt when the beams 72, and the floor portions 73 rotate.

Therefore, also when the amusement device 5 is thus configured, the movement of the players Y themselves playing within the play area S and the rotating movements of the frame body 70, the partition portion 71, the beams 72 and the floor portions 73 are combined together, thereby, the players Y can enjoy varied plays and sensations which have not been provided by the conventional one. Further, it is possible to interest children around the amusement device 5 who watch the rotating movements of the frame body 70, the partition portion 71, the beams 72, the floor portions 73 and the players Y in playing with the amusement device 5, and to lead them to play with the amusement device 5.

A cushion (not shown) is provided on the upper surface of the rotating body 10, thereby, even if the players Y accidentally fall off the beams 72 or the floor portions 73, the shock can be reduced by the cushion (not shown) and it is possible to efficiently prevent the players Y from being injured.

The frame body 70 may be configured to have a circular shape in plan view by combining a plurality of bar-shaped members and annular members. The partition member 71 may be configured with a plate-shaped member instead of a sheet-shaped member, and each floor portion 73 may also be configured with plate-shaped members instead of sheet-shaped members. Further, it is possible to omit either the beams 72 or the floor portions 73. Additionally, instead of configuring the communicating portions 73*b* by providing parts where the sheet members 73*a* are not provided, the communicating portions 73 may be configured by configuring the floor portions 73 with one member and forming through holes in this member.

INDUSTRIAL APPLICABILITY

As described above, the present invention can be preferably applicable to an amusement device with which players can enjoy varied plays, and which can attract interests of children strongly.

What is claimed is:

1. An amusement device, comprising:

a rotating body provided horizontally rotatably;

a structure for playing arranged to the rotating body for letting a player play;

support unit for supporting the rotating body so that the rotating body is horizontally rotatable; and a rotation drive mechanism for rotating the rotating body horizontally, wherein the structure for playing comprises: a frame body fixedly arranged on the upper surface of the rotating body for forming a play area which is separated from the outside space, and where the player play; a partition member fastened to the frame body for forming the play area; and at least one beam mounted to the frame body across the play area.

2. The amusement device according to claim 1, further comprising a cushion provided on the upper surface of the rotating body at least within the play area.

3. An amusement device comprising:

a rotating body provided horizontally rotatably;

a structure for playing arranged to the rotating body for letting a player play;

support unit for supporting the rotating body so that the rotating body is horizontally rotatable; and a rotation drive mechanism for rotating the rotating body horizontally, wherein:

the structure for playing comprises a frame body fixedly arranged on the upper surface of the rotating body for forming a play area which is separated from the outside space and where the player play, a partition member fastened to the frame body for forming the play area, and at least one floor portion which is configured with one or a plurality of members and which partitions the play area into layered spaces; and communicating portions for allowing the spaces adjacent in the up-and-down direction to communicate with each other are formed in the floor portion.

4. The amusement device according to claim 3, further comprising a cushion provided on the upper surface of the rotating body at least within the play area.

* * * * *